US006003623A

United States Patent [19]

Miess

[11] Patent Number: 6,003,623

[45] Date of Patent: Dec. 21, 1999

[54] CUTTERS AND BITS FOR TERRESTRIAL BORING

[75] Inventor: David P. Miess, The Woodlands, Tex.

[73] Assignee: Dresser Industries, Inc., Dallas, Tex.

[21] Appl. No.: 09/066,241

[22] Filed: Apr. 24, 1998

[51] Int. Cl.[6] ..... E21B 10/36

[52] U.S. Cl. ..... 175/430; 175/426; 175/428; 175/431; 175/432; 175/434; 299/111

[58] Field of Search ..... 175/426, 428, 175/430, 431, 432, 433, 434; 451/540, 541, 542; 407/118, 119; 299/111

[56] References Cited

U.S. PATENT DOCUMENTS

| | | | |
|---|---|---|---|
| 3,847,439 | 11/1974 | Allen . | |
| 4,119,350 | 10/1978 | Sander et al. . | |
| 4,382,633 | 5/1983 | Ludlow et al. . | |
| 4,538,690 | 9/1985 | Short, Jr. . | |
| 4,558,753 | 12/1985 | Barr . | |
| 4,570,726 | 2/1986 | Hall . | |
| 4,593,777 | 6/1986 | Barr | 175/431 X |
| 4,679,639 | 7/1987 | Barr et al. . | |
| 4,694,918 | 9/1987 | Hall | 175/430 |
| 4,766,040 | 8/1988 | Hillert et al. . | |
| 5,025,874 | 6/1991 | Barr et al. . | |
| 5,078,219 | 1/1992 | Morrell et al. . | |
| 5,096,465 | 3/1992 | Chen et al. . | |
| 5,101,691 | 4/1992 | Barr . | |
| 5,111,895 | 5/1992 | Griffin . | |
| 5,120,327 | 6/1992 | Dennis . | |
| 5,141,289 | 8/1992 | Stiffler | 299/111 |
| 5,161,627 | 11/1992 | Burkett | 299/111 |
| 5,172,777 | 12/1992 | Siracki et al. | 175/431 X |
| 5,172,779 | 12/1992 | Siracki et al. | 175/428 X |
| 5,370,195 | 12/1994 | Keshavan et al. | 175/428 X |
| 5,377,773 | 1/1995 | Tibbitts . | |
| 5,379,853 | 1/1995 | Lockwood et al. | 175/434 X |
| 5,379,854 | 1/1995 | Dennis | 175/434 |
| 5,437,343 | 8/1995 | Cooley et al. | 175/431 |
| 5,460,233 | 10/1995 | Meany et al. | 175/430 X |
| 5,551,760 | 9/1996 | Sollami | 299/111 X |
| 5,706,906 | 1/1998 | Jurewicz et al. | 175/430 X |
| 5,722,499 | 3/1998 | Nguyen et al. | 175/431 |
| 5,743,346 | 4/1998 | Flood et al. | 407/118 X |
| 5,746,280 | 5/1998 | Scott et al. | 1475/430 X |
| 5,813,435 | 9/1998 | Portwood | 175/430 |
| 5,823,277 | 10/1998 | Delwiche et al. . | |
| 5,823,632 | 10/1998 | Burkett | 299/111 X |
| 5,839,526 | 11/1998 | Cisnero et al. | 175/431 |

FOREIGN PATENT DOCUMENTS

| | | | |
|---|---|---|---|
| 353241 | 1/1990 | European Pat. Off. | 175/432 |

*Primary Examiner*—David Bagnell
*Assistant Examiner*—Jong-Suk Lee
*Attorney, Agent, or Firm*—Browning Bushman

[57] ABSTRACT

Drill bit cutters and drill bits equipped with the cutters. The cutter is mounted on a bit to present the formation with a radiused, curving, side wall cutting face that is concave in one dimension and convex in another dimension. In a preferred form, the cutting face is in the form of a portion of a surface of revolution generated by an arc segment that is concave relative to the axis of revolution. The cutting face is formed on a layer of polycrystalline diamond disposed on a substrate of tungsten carbide. In another side wall cutter arrangement, a standard cylindrical cutter with a diamond cap is mounted to present the curved cylindrical side of the cap to the formation. Curved side wall cutting faces cut more efficiently than the usual flat end face of conventionally mounted cutters. A major portion of the diamond volume in a side mounted cutter trails the point of cutting face engagement with the formation to provide impact resistance and an increased diamond wear area. The radiused face cutter may be mounted in any orientation on the bit. When mounted conventionally, such that the axis of the cutter is inclined away from the bit and into the direction of bit rotation, the cutter end surface rather than the side wall cuts the formation. In this orientation, the rake of the cutter may be increased to place a second cutting surface into engagement with the formation to provide two cutting surfaces.

36 Claims, 10 Drawing Sheets

FIG. 1
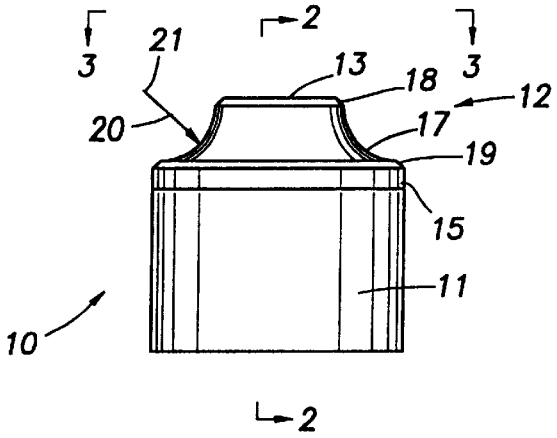
FIG. 2
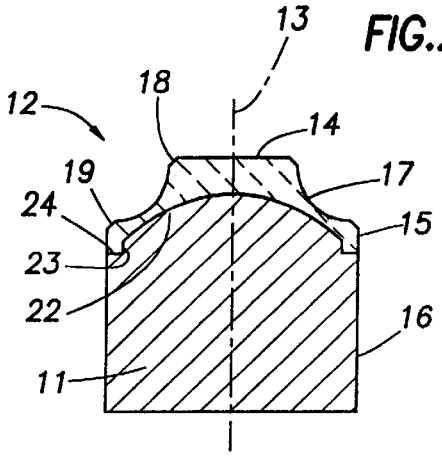
FIG. 3
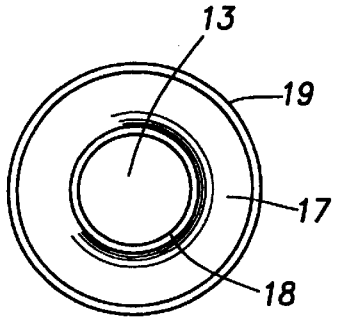
FIG. 4
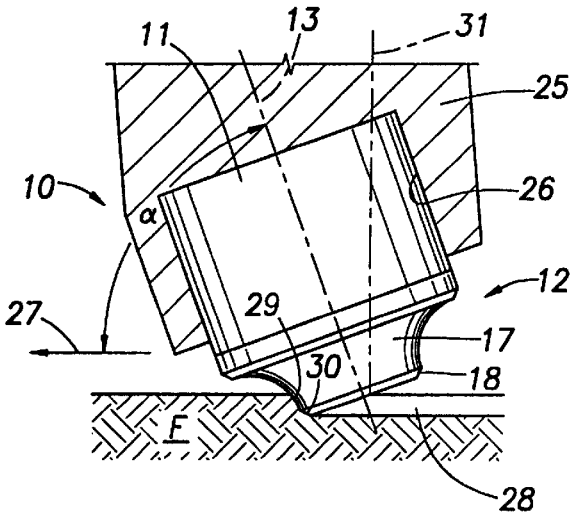
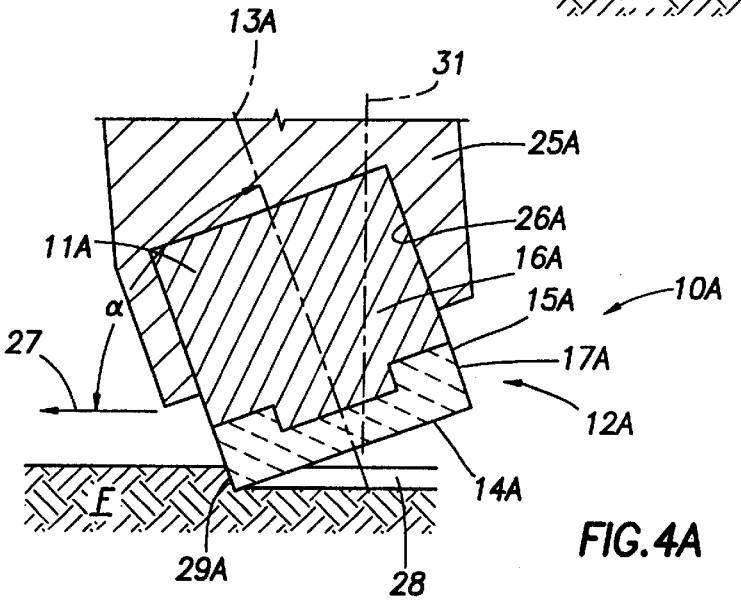
FIG. 4A 31
41
42
43
44
45
40
46
47
10'
10"
α
β
K
J
S
L
Q
R
M
N
O
P
a
b
c
d
e
f
g
h
i
1a
1b
1c
1d
1e
1f
1g
1h
1i
2i'
2i
2h
2g
2f
2e
2d
2c
2b FIG.9
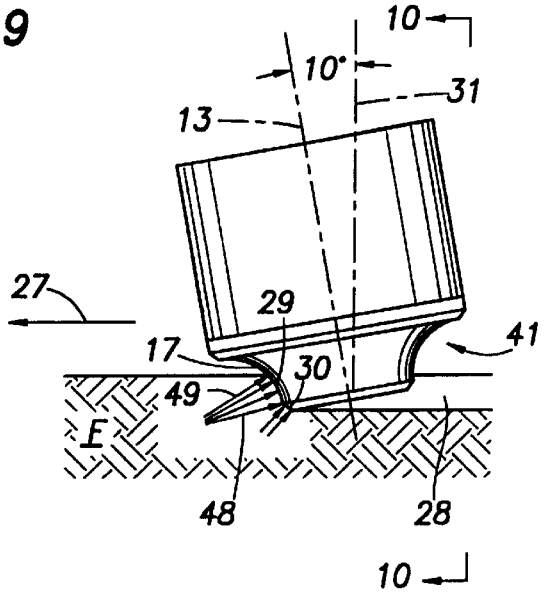
FIG.10
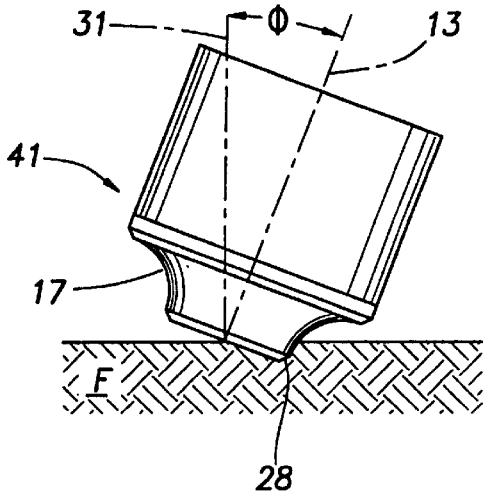
FIG.11
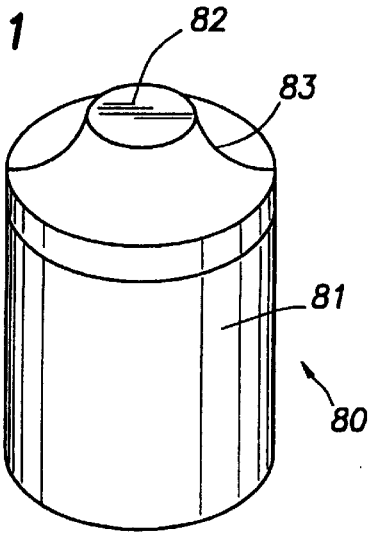
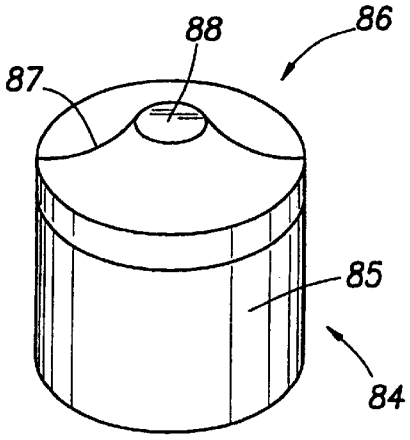
FIG.12

FIG. 13
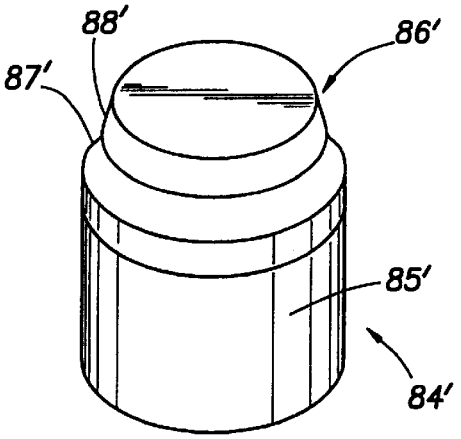
FIG. 14
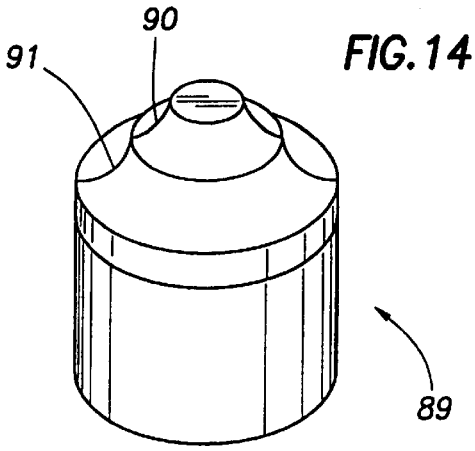
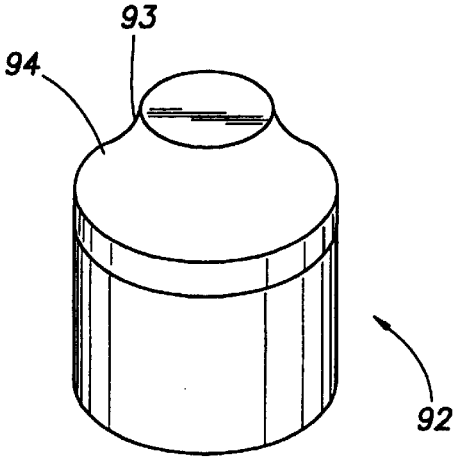
FIG. 15
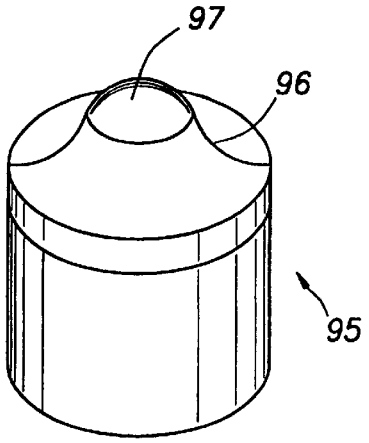
FIG. 16
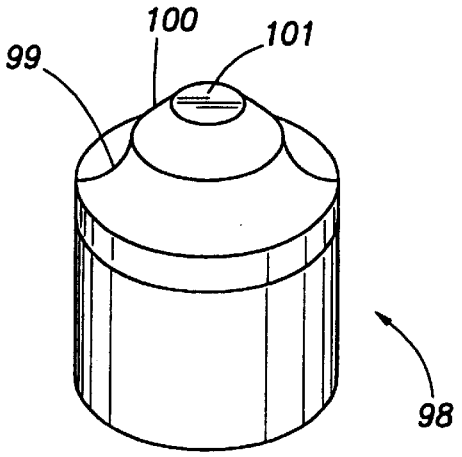
FIG. 17
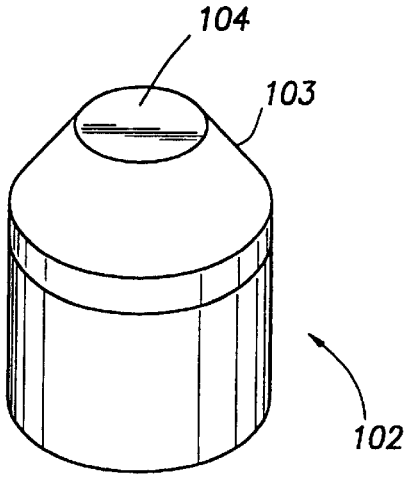
FIG. 18

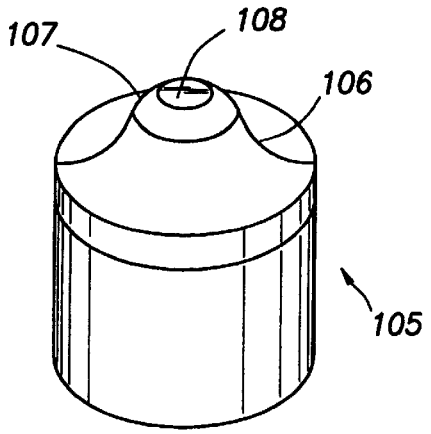
FIG.19
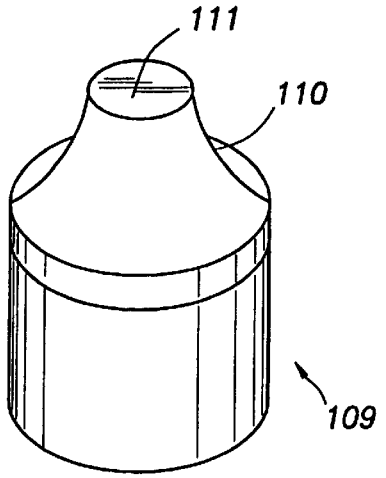
FIG.20
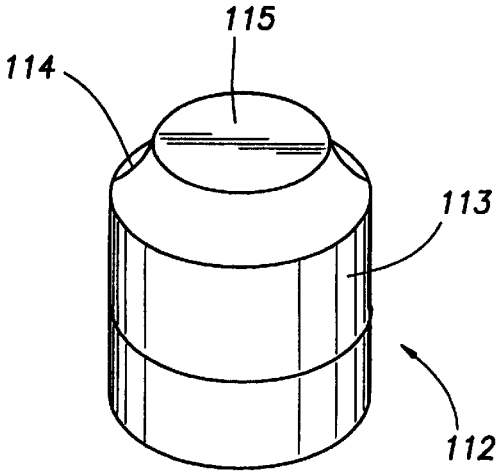
FIG.21
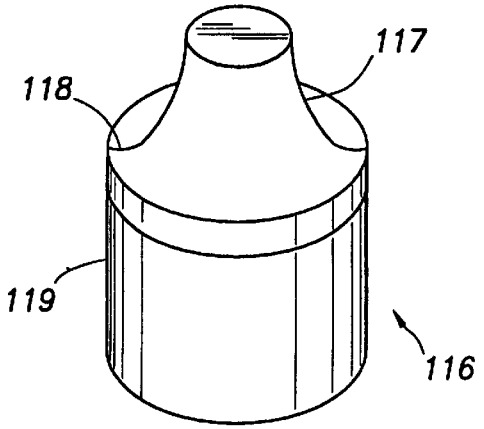
FIG.22
FIG.23
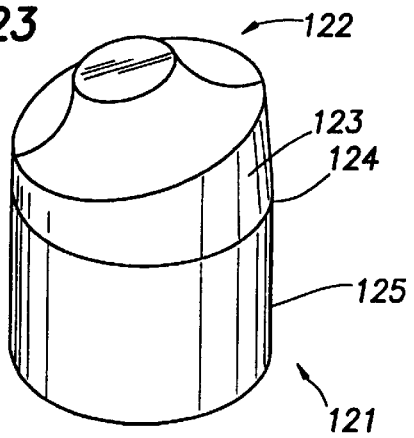

FIG.24
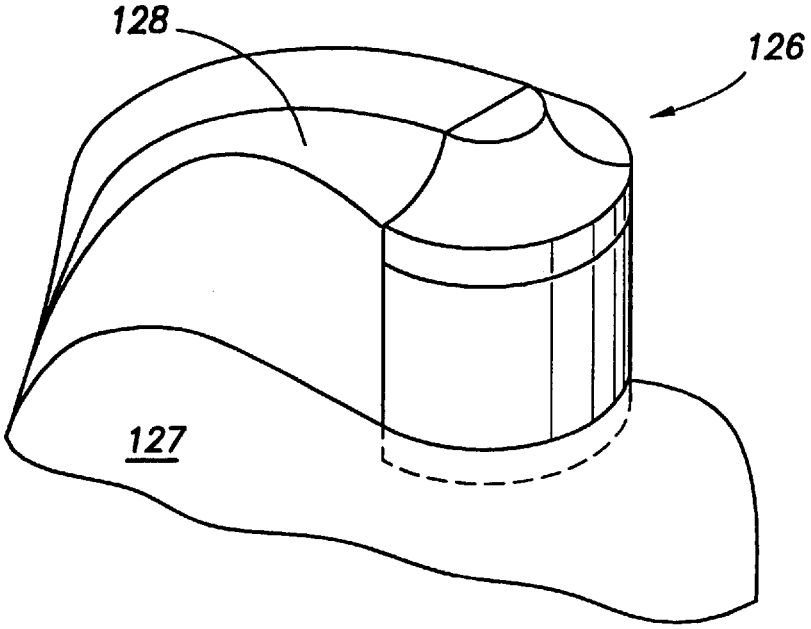
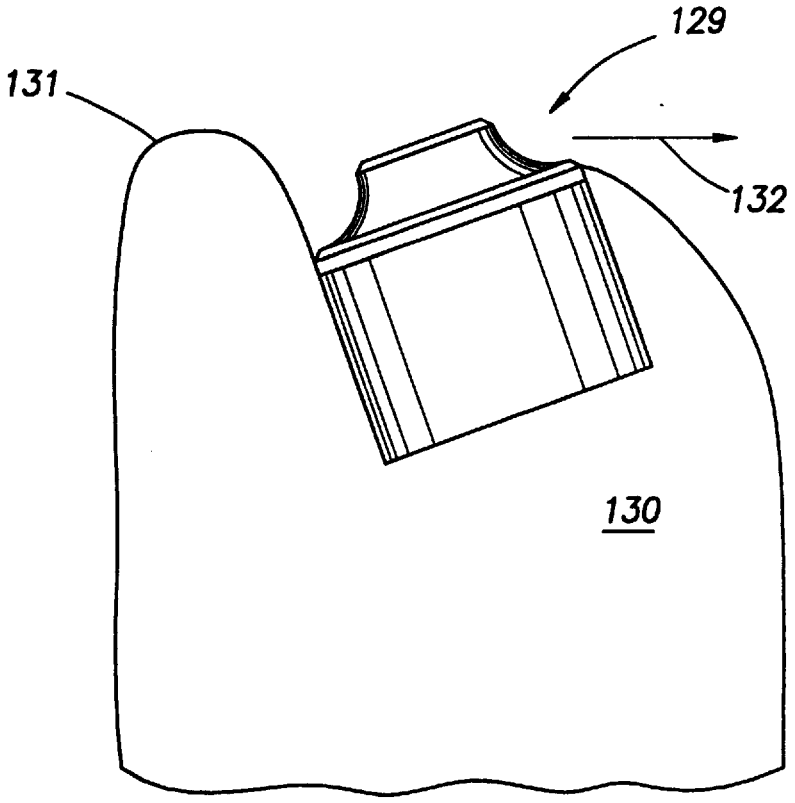
FIG.25

FIG.26
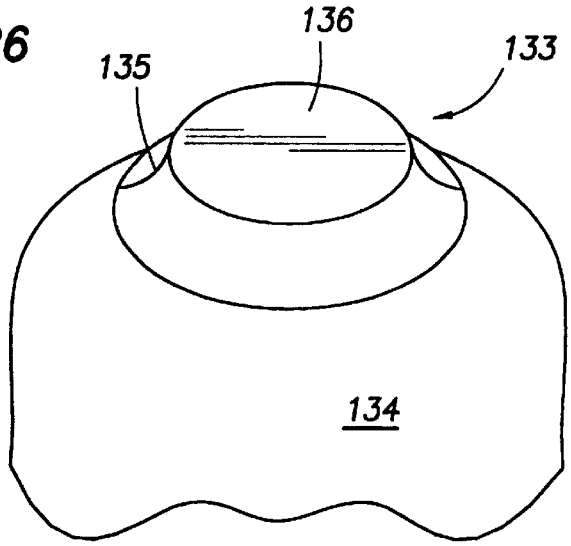
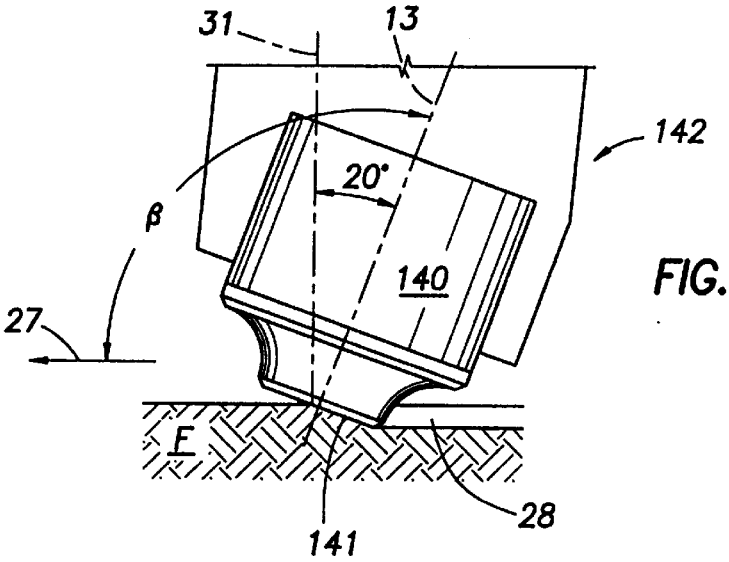
FIG.27
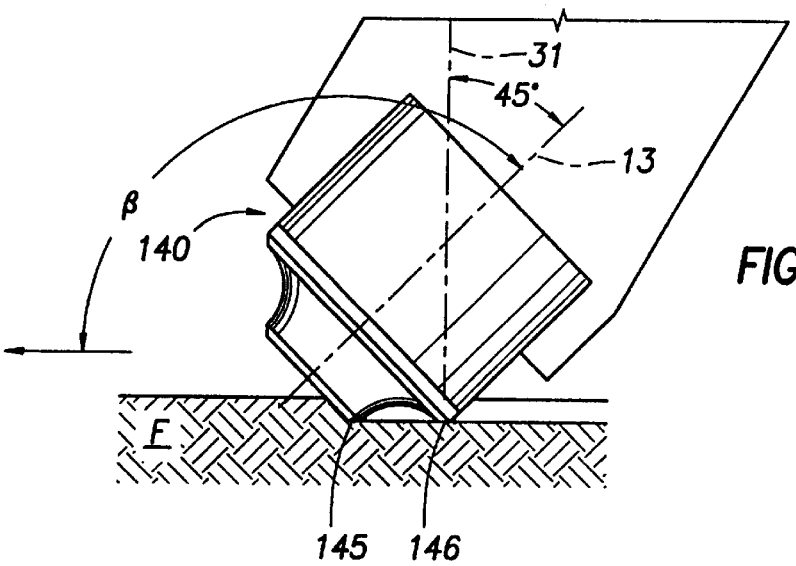
FIG.28

FIG.35
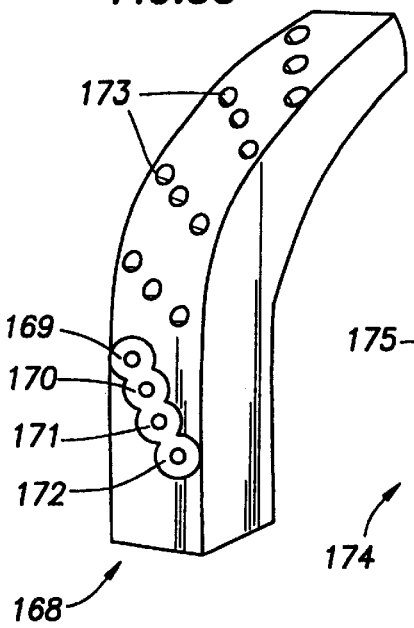
FIG.36
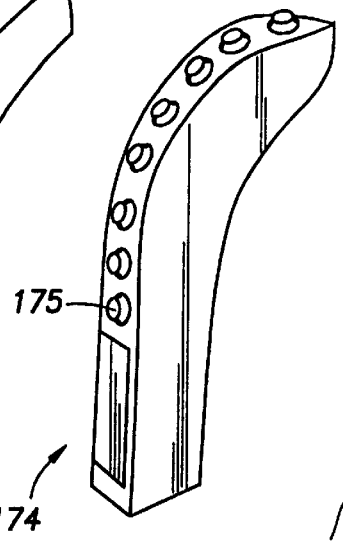
FIG.37
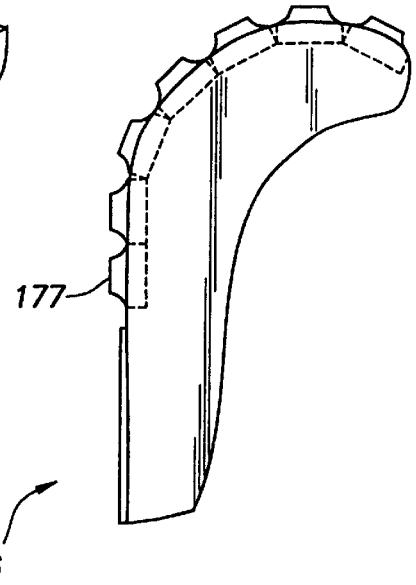
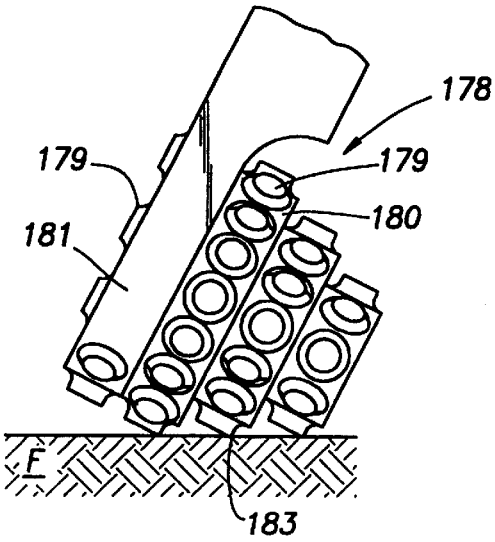
FIG.38
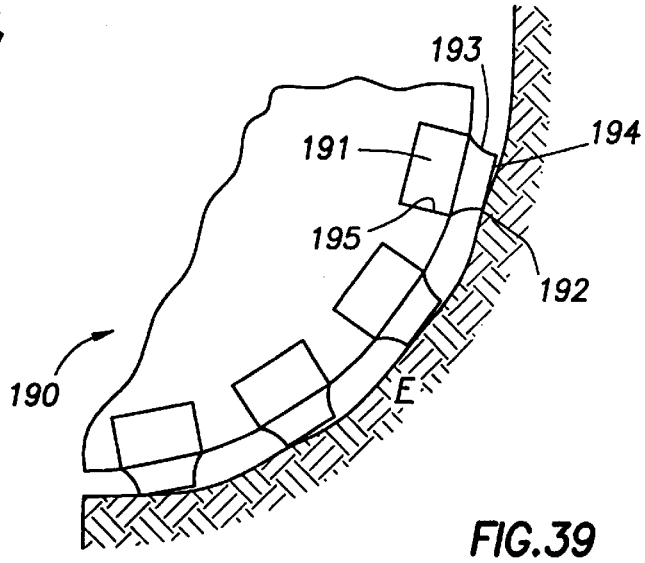
FIG.39

CUTTERS AND BITS FOR TERRESTRIAL BORING

BACKGROUND OF THE INVENTION

1. Field of the Invention

The present invention relates to equipment used in boring into terrestrial formations. More specifically, the present invention relates to bits and cutters for bits used to drill well bores into the earth for use in the recovery of hydrocarbons and other minerals.

2. Description of the Related Art

The equipment used to drill well bores in the earth for the extraction of hydrocarbons has included a variety of bits and bit cutter configurations intended to penetrate specific formations. The bits are generally either of a fixed cutter design or a roller cone design, with each design having its own benefits and advantages as applied to a particular drilling operation. The cutting action of the bit requires it to be rotated into the formation or, in the case of percussion bits, to be repeatedly impacted against the formation.

In typical bit designs, but particularly in the fixed cutter bit designs, the cutters are provided with a layer of super-hard material, such as a polycrystalline diamond carried on a softer substrate, such as tungsten carbide. As used herein, the term "super-hard material" is intended to include material that is harder than the supporting substrate, but specifically material such as a polycrystalline diamond. Other super-hard materials are also commonly employed for cutters. The substrate material is generally a cemented tungsten carbide but may be comprised of other materials. Examples of materials suitable for use as super-hard materials and substrate materials may be found in U.S. Pat. Nos. 4,679,639; 5,096,465; 5,111,895; and 4,766,040.

The diamond layer of the cutter is provided to enhance the cutting characteristics and longevity of the cutter. The methods of applying these super-hard layers to the cutter substrate and the mounting of the composite cutter body to a bit, as well as the materials employed for the cutters and bits, are the subject of a large number of patents and an extensive body of complex technology. Generally, the various super-hard materials and substrates used in the manufacture of cutters for bits are well known and, per se, form no part of the present invention. The methods for bonding the substrate and super-hard materials to each other for mounting the cutter to the bit body are also well known and are not, per se, a part of the present invention.

The history of the development of cutter fabrication and bit design is replete with examples of significant benefit deriving from only a small change in an existing cutter face design or composition of material, or even a method of fabricating the components of the bit. In some cases, the technical basis for the improved results stemming from these small changes is not well understood. The evidence of the improvement is seen in such objective criteria as an increased rate of penetration, a reduction in bit wear, a longer bit life, a reduction in the cost of manufacture, or other similar result deriving from the improvement.

The cutting face on the cutter element itself is also the subject of intensive design and engineering effort. Cutting faces on the cutters of fixed cutter bits, as well as roller cone bits, have assumed a variety of different configurations, each with one or more special features intended to improve the quality of the bit's drilling action. A large number of the prior art cutter faces employ a planar diamond surface or table carried at the end of a cylindrical tungsten carbide mounting body. The cross-sectional profile of the planar surface is often circular or may be oblong, the latter form generally being referred to as a "tombstone" cutter. Generally, the cutting face, which is intended to engage the uncut formation, is mounted on the bit such that the plane of the cutting face is angled relative to the direction of the cutter rotation. If the face plane is angled away from the direction of rotation, the cutter is said to have a negative rake. A cutter face normal to the direction of bit rotation has a zero rake, and a face angled into the direction of bit rotation has a positive rake. Cutter faces that are inclined laterally relative to the direction of cutter rotation are said to have a side rake.

It is also common to provide a curving, rather than a planar, cutting face on the cutter. Concave curving faces on fixed cutter bits are illustrated, for example, in U.S. Pat. Nos. 4,538,690; 4,558,753; 4,593,777; 4,679,639; 5,025,874; 5,078,219; 5,101,691; 5,377,773; and 5,460,233. A recognized feature of the curving cutting face is that a single curved surface can provide a variable rake angle along the cutting surface of the face.

U.S. Pat. No. 5,706,906 (the '906 patent) illustrates a variety of cutting faces that are curving, planar, concave, or convex, and various combinations thereof. The cutter faces described in the '906 patent are generally oriented on the bit to direct cutting forces toward the center of the cutter in the area of the longitudinal axis of the cutter that extends generally transversely to the plane of the cutting face. The wear pattern of the '906 cutters generally extends from the leading cutting face to the cylindrical side of the cutter. The cutting faces of the cutters of the '906 Patent are described for use in a conventional mounting orientation on the bit with the central axis of the cutter being positively inclined so that the cutter mount pushes the cutting face into the formation. In general, a major portion of the diamond in the '906 cutters is positioned ahead of the point of engagement of the cutter with the formation.

U.S. Pat. No. 4,570,726 (the '726 patent) illustrates a cutter having a cutting face with a negative rake angle formed primarily along the side of a cylindrical support or shank. The wear pattern of the cutter extends from the leading cutting face along the cutter side toward the axial cutter end. One form of the cutting face is a partial cylindrical wall that extends generally parallel to the axis of the cutter. Other forms show a relatively complex working or cutting surface that is non-parallel to the axis. The shank is secured to the cutter such that the cutter face has a negative rake angle and a curved contact area for engaging the formation. An abrasive substance is deposited over the contact area but is not deposited on the free axial end surface of the cutter. The cutter face of the '726 patent is described as being either symmetrical or nonsymmetrical, as desired, for a particular application. The formation contact portion of one embodiment of the '726 patent is described as having a leading part that has a convex cross-section in one plane with side parts having cross-sections that are partially convex and partially concave. The cutter is described as having improved material flow and strain features.

The '726 patent describes a cutter in which the interface between the abrasive material and the supporting substrate forms an edge of the cutting surface that acts as a self-sharpening edge. This design, while effective in maintaining a sharp cutting edge as the bit wears, sacrifices bit life and design flexibility for cutting efficiency. The edge exposed to the uncut formation is also more prone to chipping or spauling of the super-hard abrasive layer as the underlying substrate wears away. Impact resistance of a self-sharpening cutter face is generally also not as good as that expected from a cutter face that is comprised exclusively of superhard material. The requirement for a substrate-to-abrasive material interface in the cutting face also reduces the design flexibility for providing relatively large volumes of diamond in the wear area of the cutter.

Cost is an important consideration in the fabrication of bit cutter elements. Generally, the more complex the cutter surface, the more difficult and expensive it is to fabricate the cutter. It is also generally true that a nonsymmetrical cutter face is more complex and thus more expensive to produce than a symmetrical face. Diamond cutters are usually formed in a press to shape and bond the diamond and substrate materials. Complex diamond cutting surfaces, however, are not easily formed in the pressing process. Where a complex shape is required, it is usually necessary to cut the shape with an electrical discharge machining process or to machine the desired shape from a pressed symmetrical diamond cutting surface. The machining step adds cost to the fabrication of the final cutter. Any cutting face design that may be pressed into the diamond rather than being machined is generally less expensive to fabricate. Complex designs, such as the geometric shapes described in the '726 patent, are difficult to form in a press and, to the extent that they are not capable of being turned on a lathe or centerless grinder, are equally difficult to machine.

SUMMARY OF THE INVENTION

One aspect of the invention relates to the orientation of the diamond cutting face relative to the formation to be cut. Another aspect of the invention relates to the specific configuration of the cutter independently of its orientation relative to the formation. Yet another aspect of the invention relates to both the orientation and the configuration of the cutter.

The cutter of one form of the present invention may be mounted on a bit at different orientations to provide a wide range of cutting faces. In one orientation, the side of the cutter provides the cutter face, and in another orientation, the axial end of the cutter provides the cutter face. The side face presents a primarily curving cutting surface to the formation, and the end face presents a primarily planar cutting surface to the formation. The cutter may also be oriented to simultaneously present both a planar cutting surface and a second curving cutting surface that cuts behind the planar surface. Each form and mounting of the cutter provides a cutting face exclusively of diamond and a wear pattern that develops in the areas of the major volume of the diamond.

In the practice of one form of the present invention, a prior art cylindrical cutter having a diamond end cap is mounted on a bit in a novel manner to produce new and unexpected cutting efficiency. A prior art cylindrical cutter having a diamond cap with a planar axial end table of diamond, such as illustrated and described in U.S. Pat. No. 5,120,327, in accordance with the teachings of the present invention, is mounted such that the cylindrical side of the diamond cap engages the uncut formation to provide the cutting face. In a conventionally oriented cutter of this type, the cutter is mounted on the bit so that the flat axial end of the cutter provides the cutting face. In the present invention, the cutter is oriented on the bit so that the side surface of the diamond has a negative rake angle relative to the direction of bit rotation. The diamond cutting face engages the formation with a curving, convex surface that efficiently cuts the formation as the cutter is advanced by the rotating bit. Unlike the cutter of the prior art '726 patent, having no abrasive material over the cutter end, the cutter of the present invention is provided with a layer of diamond that extends laterally over the axial end of the cutter. The orientation of the cutter, being dragged rather than pushed through the formation, also disposes a major portion of the diamond material behind the point of engagement of the cutter with the formation. In a conventional orientation of diamond-capped cutters, a major portion of the diamond material extends over and ahead of the cutter engagement with the formation.

As the diamond cap of a cutter mounted in accordance with the teachings of the present invention wears, the wear pattern remains exclusively within the diamond cap for a major part of the cutter life. The benefit is a longer lasting cutter. The increased volume of diamond in the cutter cap trailing the point of formation engagement also improves the strength, impact resistance, and the heat transfer of the cutter to further extend its life. Because the cutter may be formed in a press and employed without significant modification in its "as pressed" form, the cost of cutter fabrication is reduced as compared with other complex side cutting face designs.

One form of the cutter of the present invention provides a diamond cap on a cylindrical tungsten carbide mount with a concave external side wall formed in the diamond cap. In its general form, the cutting face has a concave surface in some dimensions and a convex surface in other dimensions with each concave and convex dimension having a common point of intersection. This surface form is herein sometimes referred to as a "radiused" surface or face. In a preferred specific embodiment of the cutter, the side wall is radiused and has the form of a surface of revolution of an arc segment that is concave relative to the central axis of the cap. The side wall forms a concave line of intersection with a plane parallel to the axis of revolution and a convex line of intersection with a plane normal to the axis. The external axial end of the cap is a planar circular surface having a diameter less than that of the cap wall.

When mounted with the radiused section as the cutting face, the cutter presents a variable rake angle to the formation as the depth of cut changes or the cutter wears. This feature permits the cutter to be employed more efficiently in variable hardness formations and also allows the bit to wear to cutting characteristics that are better suited to the requirements of a deepening well bore. The described cutter design and orientation also reduce over-engagement of the cutter and formation as well as to prevent excessive torque buildup, causing slipping and sticking of the bit.

The configuration of the cutter, when mounted with the radiused diamond wall as the cutting face, directs cutting and impact forces acting on the cutter into the large volume diamond layer of the cap. The forces are largely directed laterally through the major diamond dimensions of the cap rather than longitudinally along the cap axis as would be the case when the end of the cutter acts as the cutting face. In this orientation with the cutting face on the side of the cutter, the wall cutter carries a major portion of its diamond cutting volume behind the point of engagement with the uncut formation, as is the case with the similarly oriented cylindrical wall cutter.

In any orientation of the radiused cutter, the radiused side walls assist in deflecting formation cuttings away from the cutting face to improve the cutting efficiency and cutter cleaning.

Unlike cutters with a conventional planar cutting face, the radiused side wall presents a constantly curving, wedge-like engagement with the uncut formation to further improve cutting efficiency. The cutting face changes with wear so that both the lateral and longitudinal dimensions of the cutting face engagement with the formation change at an increasing rate as the wear moves up the radiused wall.

The radiused cutter may also be oriented on the bit with side rake as well as back rake to present additional cutting faces to the formation. In any such orientation of side rake, negative rake, or a combination thereof, the configuration of the cutter presents a curving diamond cutting face to the formation. In virtually every orientation of the cutter, the diamond cap presents a cutting face in which the cutting and impact forces, as well as the wear pattern, are concentrated in the major volumes of the diamond cutting structure.

The radiused cutter of the present invention may be mounted on the bit in a conventional orientation with the planar end surface of the diamond cap acting as the primary cutting face. In such an orientation, the configuration of the cutter concentrates impact forces along major diamond dimensions of the cap to reduce fracturing and spauling of the diamond. The radiused side wall of the diamond cooperates with the circular planar end table to disperse the forces of impact. The curving interfaces between the cap wall and the end table, as well as the curving interface with the tungsten carbide substrate, prevent concentration of cutting or impact forces.

The cutter of the present invention may also be mounted in a bit with the end of the cutter acting as the primary cutting face and the base of the radiused diamond cap acting as a second cutting face. In this arrangement, the diamond cap end is a planar cutting face, and the diamond wall is a curved cutting face.

In each form and mounting of the cutter of the present invention, the cutter presents a force-resistant cutting face of diamond to lateral, as well as forward or reverse, bit movement. The result is a stronger bit with significantly fewer cutter failures.

The ability of the cutter of the present invention to resist damage from impact forces applied from virtually any direction renders the cutter particularly useful in roller cone bits and percussion bits. In any bit form, cutters of a single design may be mounted in bits of the present invention at different locations and at different rake angles and orientations to produce desired drilling characteristics. Because of the symmetrical configuration of the cutters, the bit may be renewed by rotating the worn cutters in their bit sockets to present unworn cutting surfaces to the formation.

The radiused cutter is also capable of maintaining a relatively large volume of diamond as a cutting section in the event the smaller end of the diamond cap is broken or worn away to reduce a "ring out" on the bit. "Ring out" is generally a catastropic failure resulting from the loss of a single cutter on the bit, causing other cutters in the same radial dispositions to sequentially fail.

From the foregoing, it will be appreciated that a major object of the present invention is to mount a cylindrical diamond-capped cutter on a bit to present the curved side of the diamond cap as the formation cutting face whereby the end diamond layer functions as a force absorbing structure rather than a primary cutting face structure.

It is an object of the present invention to provide a bit having cutters in which a major portion of the diamond material of the cutters is disposed to the rear of the cutter's engagement with the formation to thereby strengthen the cutter, absorb the forces of cutting and impact, and better distribute the heat generated as the formation is cut.

A primary object of the present invention is to provide a cutter face that is capable of being manufactured in an "as pressed" form that has superior cutting capabilities with increased impact resistance and superior wear resistance.

Another object of the present invention is to provide a cutting face for a cutter that is resistant to impact damage from a range of directions and that provides a large volume of diamond in the area of maximum wear and/or force application to extend the life of the cutter.

Yet another important object of the present invention is to provide a cutter face that can present a variable rake angle to the formation being cut as the depth of the formation cut changes and/or the cutter wears. It is also a related object to provide a cutter face that may present different rake angles to the formation by varying the orientation of the cutter mount on the drill bit.

Another object of the present invention is to provide a cutter face that, over a wide range of orientations, can tolerate side and reverse loading and impact without damage to the cutter.

It is yet another object of the present invention to provide a cutter face that allows cuttings being removed from the formation to move past the cutter and away from the cutter face to improve the cutter efficiency.

It is also an object of the present invention to provide a stud-type cutter that may be oriented on a bit with a planar cutting face presented to the formation or oriented on a bit to present a radiused side wall as the cutter face. It is also an object of the present invention to provide a single cutter that may be mounted to simultaneously present multiple, spaced cutting edges to the formation as the bit is rotated.

Another important object of the present invention is to provide a cutter that can be rotated in its mounting whereby new cutting surfaces may be exposed for engagement with the formation to replace cutting surfaces worn through use.

Another object of the present invention to provide a cutter having omnidirectional cutting and force-absorbing capabilities.

The foregoing, as well as other, features, advantages, and objects of the invention will be more fully appreciated and understood by reference to the following specification, drawings, and claims.

BRIEF DESCRIPTION OF THE DRAWINGS

FIG. 1 is a vertical elevation, partially in section, illustrating a preferred form of a radiused wall cutter of the present invention;

FIG. 2 is vertical cross-section taken along the line 2—2 of FIG. 1 illustrating details in the interface between the diamond cutter cap and the tungsten carbide substrate of the cutter of FIG. 1;

FIG. 3 is a plan view taken along the line 3—3 of FIG. 1 illustrating the top surface of the cutter;

FIG. 4 is a vertical elevation illustrating the cutter of the present invention mounted on a fixed cutter drag bit and being rotated into cutting engagement with a formation;

FIG. 4A is a vertical cross-section illustrating a cylindrical cutter mounted to present a side wall of a diamond end cap as the formation cutting face;

FIG. 9 is a vertical elevation, partially in section, schematically illustrating negative rake variations along the radiused cutting face of a cutter of the present invention along the engagement of the leading edge of the cutter with the formation;

FIG. 10 is a vertical elevation, partially in section, taken along the line 10—10 of FIG. 9 schematically illustrating the side rake mounting angle of the cutter;

FIGS. 11–23 are vertical elevations illustrating various cutter configurations of the present invention;

FIG. 24 is a vertical elevation illustrating a cutter of the present invention mounted on a bit;

FIG. 25 illustrates a cutter of the present invention mounted on a bit with an impact arrestor;

FIG. 26 illustrates a cutter of the present invention deeply mounted in a bit socket;

FIG. 27 is a vertical elevation, partially in section, illustrating a cutter of the present invention conventionally oriented on a bit with a planar axial diamond end surface forming the cutting face;

FIG. 28 is a view similar to that of FIG. 27 illustrating the cutter at a rake angle that applies two cutting edges to the formation;

FIG. 35 is a vertical elevation illustrating a rotary drag bit blade equipped with cutters of the present invention arranged in a spiral configuration;

FIG. 36 illustrates a vertical elevation of a rotary drag bit blade provided with the cutters of the present invention arranged in a linear configuration along the blade edge;

FIG. 37 is a vertical elevation of a drag bit cutter blade having the cutters of the present invention arranged continuously along the outer edge of the blade;

FIG. 38 is an elevation of a portion of a roller cone bit illustrating the cutter of the present invention applied to a roller cone and arm of a roller cone bit; and FIG. 39 is an elevation, partially in section, illustrating a cutter of the present invention applied to a percussion bit.

DESCRIPTION OF THE PREFERRED EMBODIMENTS

Figures 5, 6:
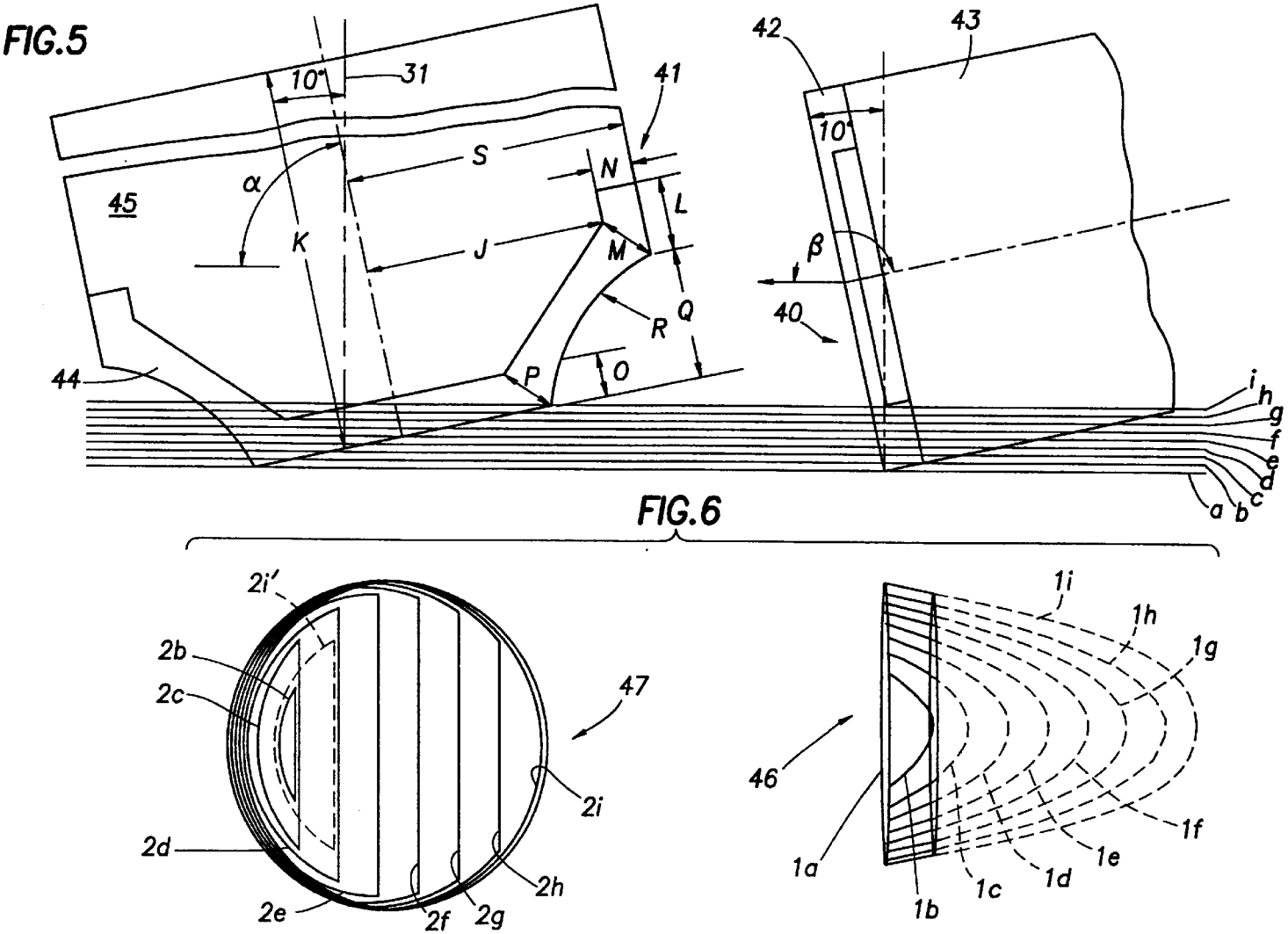
FIG. 5 is a schematic vertical elevation illustrating wear depths in a conventionally mounted prior art cutter and the cutter of the present invention, both having a 10° negative rake.
FIG. 6 is a horizontal schematic view of the wear pattern produced in the conventionally mounted prior art cutter and the cutter of the present invention at the corresponding wear depths illustrated in FIG. 5.

A preferred form of the cutter of the present invention is indicated generally at 10 in FIG. 1. The cutter 10 is constructed of an axially and laterally extending cylindrical mount section 11 having a cutting section 12 formed at one of its axial ends. The cylindrical mounting section is constructed of a material such as a cemented tungsten carbide, and the cutting section 12 is constructed of a super-hard material such as a polycrystalline diamond. The cutter 10 is symmetrically formed around a central axis 13.

By joint reference to FIGS. 2 and 3, it is seen that the cutting section 12 is in the form of a closed end tubular body, or cap, of diamond that overlies the axial end of the cylindrical mounting section 11. A planar axial end surface 14 is provided at the end of the cap 12. The surface 14 is normal to the central axis 13. The diamond cap 12 includes a cylindrical wall section 15 that extends to a cylindrical outer wall 16 on the mounting section 11. An annular, arc surface 17 extends laterally and longitudinally between the planar end surface 14 and the external surface of the cylindrical wall section 15. The surface 17 is in the form of a surface of revolution of an arc line segment that is concave relative to the axis of revolution. In the form of the cutter illustrated in FIGS. 1–4, the axis of revolution producing the surface 17 is the central axis 13.

An annular bevel, or chamfer, 18 extends between the planar surface 14 and the arc surface 17. A similar chamfer 19 extends between the base of the surface 17 and the external wall surface of the cylindrical wall section 15. The radius of curvature of the arc surface 17 is indicated at 20 with a center at 21. The surface 17 is, at times, herein referred to as a "radiused" surface.

The surface 17, in its preferred form, is characterized in that it forms a concave, curving line of intersection with a plane that extends parallel to the axis of rotation of the arc segment while forming a convex, curving line of intersection with planes normal to the axis of revolution. In its more generalized form, the radiused surface 17 may be any external concave surface that forms a concave line of intersection with a first plane passing through the surface along one dimension and a convex line of intersection with a second plane passing through the surface along another dimension where the first and second planes also intersect at a point on the surface. The radiused surface is also preferably, but not necessarily, symmetrical about a central axis of symmetry. A surface having the shape of the present invention may be described as being concave along a first dimension and convex along a dimension intersecting the first dimension.

The interface between the diamond cap 12 and the substrate 11 is in the form of a hemispherical dome 22 extending to a reduced cylindrical section 23 and ending in an annular shoulder 24.

FIG. 4 of the drawings illustrates the cutter 10 mounted in its preferred orientation on a bit body 25, the bit body being only partially illustrated. For purposes of the following explanation, the bit body 25 is a conventional fixed cutter rotary drag bit. The mount section 11 of the cutter 10 is received in a cylindrical recess or socket 26 formed in the bit body. The cutter is illustrated turning in the direction of an arrow 27 against a terrestrial formation F. The cutter is illustrated advancing a leading surface area into uncut formation and creating a trailing cut or kerf 28.

The effective cutting face of the cutter 10 is provided primarily by a section 29 of the arc surface 17 and secondarily by a section 30 of the chamfer 18. The segments 29 and 30 engage the uncut formation. While a chamfer 18 has been illustrated on the cutter 10, the present invention may be made and used without a chamfer. The chamfer 18, when used, is not the major part of the cutting face.

The orientation of the cutter 10 in FIG. 4 is such that the axis of rotation 13 of the surface 17 is inclined forwardly relative to the direction of cutter rotation illustrated by the arrow 27. In the orientation of FIG. 4, the cutter 10 is inclined approximately 10° from a line 31 normal to the formation F. The effective cutting face formed by the sections 29 and 30 presents a negative rake angle for the cutting face relative to the uncut formation F. It may be observed that the axis 13 of the cutter 10 forms an acute angle $\alpha$ with the direction of cutter movement and that a major portion of the diamond cap 12 trails the engagement cutting face.

One aspect of the present invention is a bit employing prior art cutters oriented in a manner to produce a new cutting structure. FIG. 4A illustrates a prior art cylindrical cutter indicated generally at 10A. The cutter 10A includes a cylindrical tungsten carbide mounting section 11A and a diamond cap 12A. The cutter 10A is symmetrically formed about a central axis 13A extending longitudinally through the cutter body. The axial end of the cutter 10A is overlayed with a diamond layer having a flat external surface 14A. The external wall surface of the diamond cap 15A coincides with the external wall surface of the cylindrical mount 16A. The cutting area of the cutter 10A is formed by a cylindrical surface 17A formed along the outer wall of the diamond cap 12A.

The cutting face of the cutter 10A is provided by the surface 29A engaging the uncut formation F. As with the cutter 10, the cutter 10A provides a wear pattern of diamond that exists until the cutter has worn to the level that the tungsten carbide substrate 16A is reached. Similarly, the cutter 10A provides a curved cutting surface on its leading profile during the life of the cutter.

In the arrangement of FIG. 4A, the central axis 13A of the cutter 10A makes an angle of approximately 20° with a line 31 normal to the formation F. The cutting face 29A is in the form of a surface of revolution of a straight line segment rotated about an axis of revolution corresponding with the central axis 13A. The cutter surface of FIG. 4A is formed by a line segment that is revolved parallel to the central axis 13A. It will be understood that the line segment may be inclined relative to the axis of revolution to form a conical wall surface to produce a corresponding conical surface for the cutting face 29A. As with the cutter illustrated in FIG. 4, the cutter 10A deploys a major portion of the diamond volume of the cap 12A behind the cutting face 29A. Also, as with the form of the cutter illustrated in FIG. 4, the axis 13A of the cutter 10A forms an acute angle $\alpha$ with the direction of cutter rotation.

With reference to FIGS. 5 and 6, a comparison is made between the wear flat areas produced in a prior art cutter 40 and a cutter 41 of the present invention. The prior art cutter 40 in FIG. 5 is equipped with a cap 42 of polycrystalline diamond over a cylindrical, tungsten carbide substrate body 43. The cutter 41 of the present invention is provided with a diamond cap 44 carried atop a frustoconical end section of a tungsten carbide cylinder 45.

As illustrated in FIG. 5, the prior art cutter 40 is disposed with a 10° negative rake cutter face while the cutter 41 of the present invention is disposed with its central axis at a 10° angle relative to a line normal to the formation. The illustrated orientation produces a negative rake angle for the cutting face of cutter 41 to approximate the rake angle of the cutting face of the cutter 40. The cutter 40 is mounted conventionally with the central axis of the cutter forming an obtuse angle $\beta$ with the direction of cutter movement. The cutter 41 is mounted with the central cutter axis forming an acute angle $\alpha$ with the direction of cutter movement. A series of 9 horizontal sections, a–i, indicating levels of wear on the cutter are illustrated in FIG. 5. The horizontal section a represents the initial, uncut wear pattern for the cutters, and the horizontal section i indicates the maximum wear of the two cutters, with the depth of wear being measured along the line 31 normal to the formation.

FIG. 6 illustrates the size and shape of the wear pattern created at each of the nine levels of wear illustrated in FIG. 5. The wear pattern for the cutter 40 is indicated generally at 46. The dotted lines illustrated in the wear patterns depict the tungsten carbide pattern in the underlying support cylinder; the solid lines indicate the wear at each corresponding level for the diamond layer of the cutter. Thus, the line 1*b* is the wear pattern formed in the diamond layer 42 of the cutter 40 when the diamond cap has worn to the level b illustrated in FIG. 5. At this point, no carbide is exposed to the formation. Wear on the cutter 40 extending to a depth indicated by the line c of FIG. 5 produces a wear pattern indicated by the line 1*c* of FIG. 6. As may be noted, the wear pattern extends through diamond and into the carbide substrate so that the cutter 40 is engaging the formation with the diamond-carbide interface cutting edge. Similarly, each succeeding level of wear produces a greater area of carbide relative to the diamond cutting surface. As indicated at the extreme level of wear, the wear pattern 1*i* includes an area of carbide that is many times greater than the area of diamond.

The wear pattern for the cutter of the present invention is indicated generally at 47 in FIG. 6. Wear patterns in the cutter 41 are indicated by the patterns 2*b–i* for the wear levels b–i, respectively illustrated in FIG. 5. At the first level of wear, b, a small wear pattern 2*b* is produced in the diamond 44 of the cutter 41. Wear to the level c produces a wear pattern 2*c*, still in the diamond cap 44. All succeeding wear patterns at each level remain in the diamond cap 44 until the cutter wears to the level i. At the wear level i, the wear pattern 2*i* is produced in the diamond, and the pattern 2*i'* is produced in the underlying tungsten carbide support. A comparison of the wear patterns 46 and 47 indicates clearly that the cutter design of the present invention provides a substantially greater amount of diamond in the wear area than that provided by the conventionally mounted prior art cutters. Because the cutting action of tungsten carbide is substantially different from that of diamond and because the tungsten carbide wears much more quickly than diamond, the cutter having the wear pattern of the present invention is substantially preferred to one having a wear pattern such as that illustrated by the conventionally mounted prior art cutter.

Figure 7:
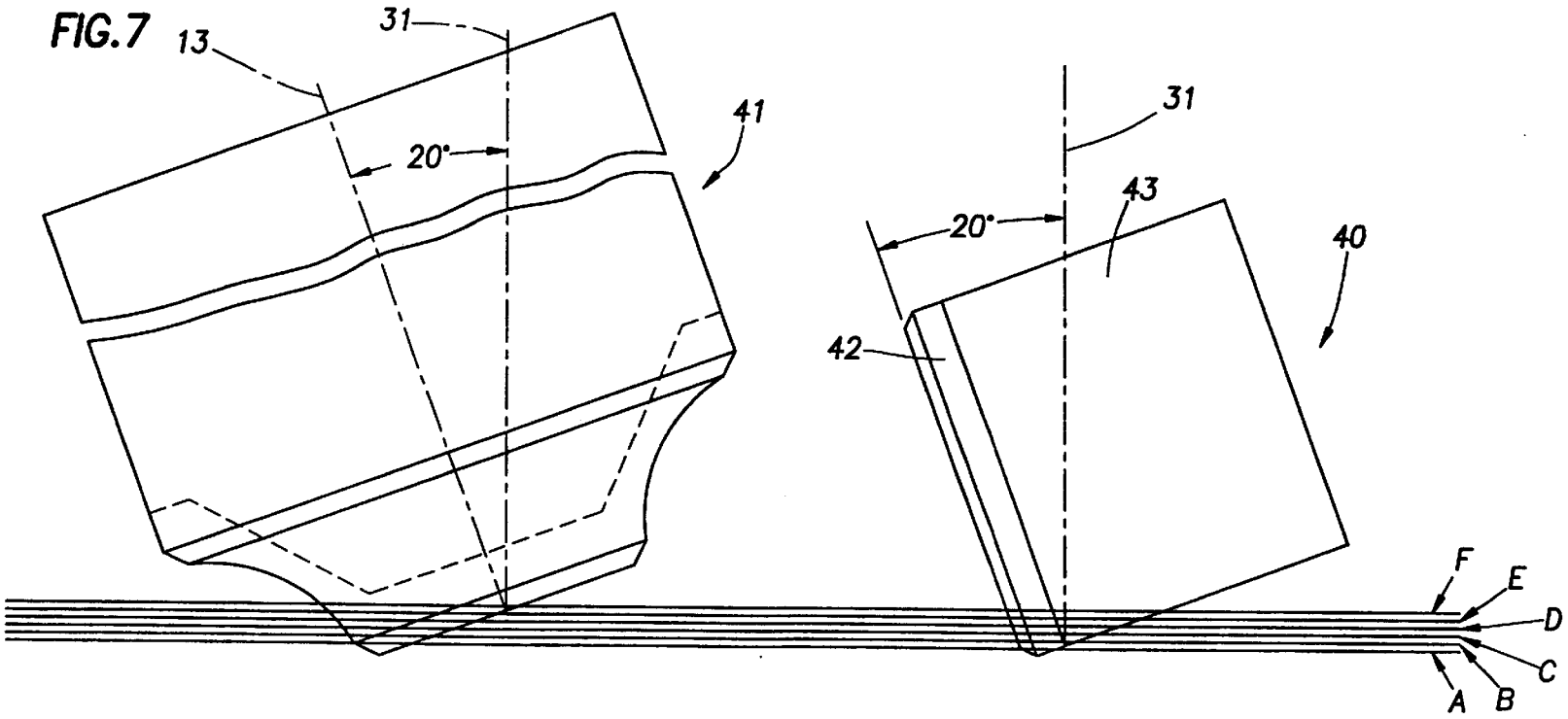
FIG. 7 is a vertical elevation illustrating wear depths in the cutter of the present invention and in a prior art cutter, both having a 20° negative rake.
Figure 8:
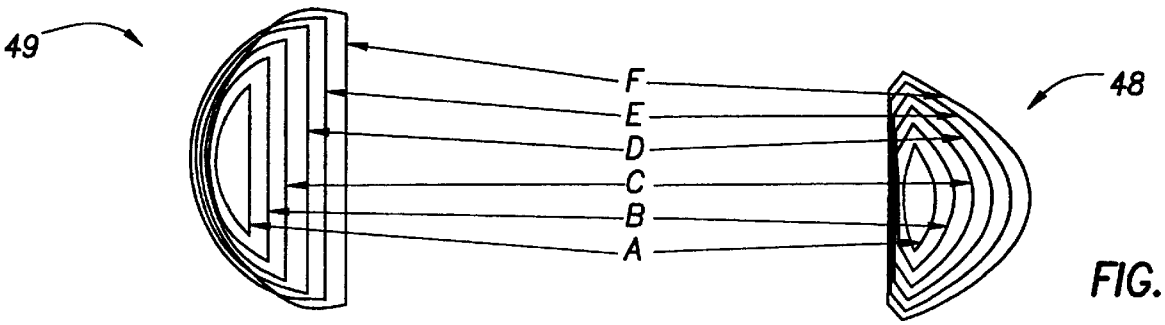
FIG. 8 is a horizontal view schematically illustrating the wear patterns of the cutters illustrated in FIG. 7.

FIGS. 7 and 8 illustrate another important feature of the cutter of the present invention. The prior art cutter 40 is illustrated conventionally mounted with a 20° back rack, and the cutter of the present invention 41 is illustrated with an orientation of its central axis 13 at a angle of 20° to a line 31 normal to the formation. Various horizontal wear levels A–F are illustrated through the cutters 40 and 41. FIG. 8 illustrates the resulting wear patterns in the cutters 40 and 41. The wear pattern for the conventionally mounted cutter 40 is indicated at 48, and the wear pattern for the cutter 41 of the present invention is indicated at 49. In FIG. 8, it will be understood that letters A–F designate the wear patterns in the respective cutters 40 and 41 for each succeeding level, respectively, of the wear levels A–F in FIG. 7.

As is readily apparent from comparing the patterns 48 and 49, the leading edge of the cutter 41 maintains a curving contour during the evolution of the wear flats from the minimum to the maximum depths of wear. The prior art cutter 40 maintains a flat leading surface engaging the formation as the cutter wears. The area of the flat continues to increase with increasing wear. It may be noted that during the initial life of the cutter 40, the wear patterns produced at the levels A and B have a degree of forward-facing curvature. As the wear levels recede into the cutter, the planar edge becomes a larger percentage of the total advancing surface, which increases the resistance to cutting. While such resistance to cutting is also encountered in the increasingly growing leading cutting edge of the cutter 41 of the present invention, the leading edge maintains a curvilinear shape that enhances the cutting ability of the cutter. Thus, as illustrated in FIGS. 7 and 8, in addition to providing increased amounts of diamond during the wear process of the cutter cycle as illustrated in FIGS. 5 and 6, the cutter of the present invention also maintains a sharper cutting profile during its life to maintain a cutting profile that is more efficient than the increasingly planar profile produced by a wearing conventionally mounted cutter.

FIG. 9 illustrates the cutter 41 of the present invention engaging uncut formation F as it advances in the direction of the arrow 27. The cutter 41 is oriented with its central axis 13 at an angle of approximately 10° to a line 31 that is normal to the formation F. The primary cutting face of the cutter 41 indicated by the section 29 presents a rake angle to the uncut formation that varies along the depth of the cut. The rake of the minor chamfer cutting face remains constant. The curving cutting face 29 is seen to vary from a rake angle of approximately 5° indicated by an arrow 48 to a rake angle of approximately 25° indicated by an arrow 49. That part of the radiused surface 17 above the formation continues to increase in back rake as the surface 17 extends toward its base adjacent the cylinder wall.

It may be appreciated that as the cutter 41 digs a deeper kerf 28, the back rake of the cutting face 29 will vary with the depth of cut. As the cut becomes deeper, the back rake increases, and the total volume of cutter received in the kerf increases at a rate determined by the slope of the curving surface 17. Resistance to penetration increases as the cutter forms a deeper kerf because of the cutting face contour at the increasing volume of cutter being advanced into the formation. As compared with a straight, or planar, cutting engagement face, the degree of change in volume is seen to be substantially larger with increasing depth than is provided with the conventional arrangement.

FIG. 10 illustrates the cutter 41 of FIG. 9 as it would appear from a vantage taken along the line 10—10 of FIG. 9. The cutter is shown to be mounted with a tilt or side rake $\phi$ in which the central axis 13 of the cutter is inclined relative to the line 31 normal to the formation. The tilt or side rake may be applied to either side of the line 13 as required to best cut the formation.

In the present invention, cutters mounted on a fixed cutter bit to cut along the cutter side generally have a dimension of diamond in a direction parallel to the developing wear surface that is greater than the dimension of the diamond in a direction normal to the wear surface. Cutters so mounted have a major portion of the super-hard material of the cutter trailing the cutting face relative to the direction of cutter movement.

FIG. 11 illustrates a cutter of the present invention indicated generally at 80 having an extended length cylindrical mounting section 81 for employment in a bit requiring a longer reach, such as a roller cone bit or percussion bit. The cutter 80 includes a diamond cap having a planar end surface 82 and a radiused cutting face 83.

FIG. 12 illustrates a cutter 84 having a cylindrical mounting section 85 overlaid at one end with a short axially extending diamond cap 86. The cap 86 includes a curving diamond face 87 and a planar axial end surface 88.

FIG. 13 illustrates a cutter 84 having a cylindrical tungsten carbide mount 85' and a diamond cap 86'. Two frustoconical surfaces 87' and 88' are formed by intersecting linear segments that are revolved about the central axis of the cap 86'. The cutter 84' differs from the "radiused" configurations described herein in that the concave surface formed on the diamond cap wall does not arc. The cutter 84' is intended for mounting such that the surfaces 87' and 88' form the cutting face with the axis of the cutter mounted with an acute angle relative to the direction of forward bit rotation.

FIG. 14 illustrates a cutter 89 provided with two concave, radiused side faces, each of which is a surface of revolution of a curving line segment that is concave relative to the central axis of the cutter to produce two adjoining curving sections 90 and 91.

FIG. 15 illustrates a cutter 92 of the present invention in which the diamond cap is provided with a concave external radiused surface 93 that extends down to a convex external radiused surface 94 in the diamond cap. The surface 93 is in the form of a surface of revolution generated by a concave arc line segment that is revolved about the central axis of the cutter. The surface 94 is similarly in the form of a surface of revolution of a convex line segment relative to the central axis of the cutter 92.

FIG. 16 illustrates a cutter 95 of the present invention with a diamond cap having a concave external wall surface 96 terminating in a convex axial end domed surface 97.

FIG. 17 illustrates a cutter 98 having a concave external radiused side surface 99 extending to an annular linear chamfer 100 and terminating in a planar axial end surface 101.

FIG. 18 illustrates a cutter 102 having a diamond end cap with a frustoconical external side surface 103 and terminating in a planar end surface 104.

FIG. 19 illustrates a cutter 105 having a curved side surface 106 extending to a convex dome section 107 and terminating in a planar end surface 108.

FIG. 20 illustrates a cutter 109 having a slightly radiused concave side surface 110 that extends to a planar end surface 111.

FIG. 21 illustrates a cutter 112 having a first frustoconical external surface 113 that extends up to a radiused concave surface 114 and terminating in a planar end surface 115.

FIG. 22 illustrates a cutter 116 having a diamond cap with a concave radiused surface 117 that includes a sharply concave radiused section 118 extending to cylindrical wall 119 of the supporting substrate. The axial end of the cutter terminates in a planar surface 120.

FIG. 23 illustrates a cutter 121 in which a diamond cap 122 carried on a substrate 123 is braised at 124 to a supporting mount section 125. The cutter 121 may be oriented in a nondirectional socket in the bit body to present a desired cutting face to the formation.

FIG. 24 illustrates a cutter 126 mounted in a bit section 127 with a supporting matrix backing 128. The cutter 126 may be in the form of any of the radiused cutters described herein, cut in half along their longitudinal axis to produce two cutters from a single cutter.

FIG. 25 illustrates a cutter 129 mounted in a bit section 130 with an impact arrestor 131 formed integrally in the bit section behind the cutter 129. The cutter 129 is mounted for movement in the direction of the arrow 132.

FIG. 26 illustrates a cutter 133 of the present invention carried in a bit section 134. The cutter 133 is similar to the radiused cutters described herein and includes a radiused side section 135 and a planar end section 136 that project from the bit section 134. Only the diamond cap is exposed in the mounting configuration of the cutter illustrated in FIG. 26.

FIG. 27 illustrates a radiused cutter 140 of the present invention mounted such that a planar end surface 141 of the cutter provides a leading section cutting face engaging and cutting the uncut formation F. The trailing side section of the cutter wall is in the form of a surface of revolution of a concave-shape (relative to the axis of revolution) arc section. The cutter 140 is mounted in a bit section 142 with an orientation of approximately 20° between the central axis 13 of the cutter and a line 31 normal to the formation F. The cutter 140 is mounted to move in the direction of the arrow 27 to produce a kerf 28 as the cutter is advanced through the formation. As oriented in FIG. 27, the cutter 140 produces a single cutting face engaging the formation F. It may be noted that the cutter 140 is mounted in a conventional orientation in which the central cutter axis 13 forms an obtuse angle β with the direction of cutter rotation.

FIG. 28 illustrates the radiused cutter 140 conventionally oriented with the central axis of the cutter 13 having an angle of approximately 45° with a line 31 normal to the formation. As illustrated in FIG. 28, the cutter 140 engages the formation F at cutter faces 145 and 146, to engage two cutting faces with the formation. The leading cutting face 145 is primarily a planar surface, and trailing the cutter face 146 is primarily a curving surface.

FIGS. 29–34 illustrate variations in the diamond and substrate arrangements for cutters of the present invention, each employing an external radiused profile of the present invention.

Figure 29:
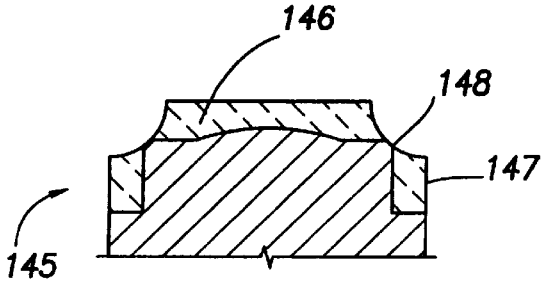
FIGS. 29–34 are vertical central cross-sections that illustrate the cutters of the present invention with diamond arrangements and various interface arrangements between the outer diamond layer and the underlying tungsten carbide substrate.

FIG. 29 illustrates a cutter 145 having a diamond cap 146 and an annular diamond ring 147 with the substrate material extending into the radiused cutting face at 148.

Figure 30:
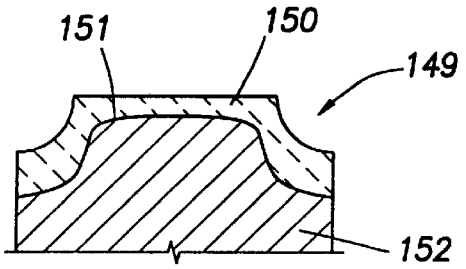

FIG. 30 illustrates a cutter 149 having a diamond cap 150 that forms a bell-shaped interface 151 with the underlying substrate 152.

Figure 31:
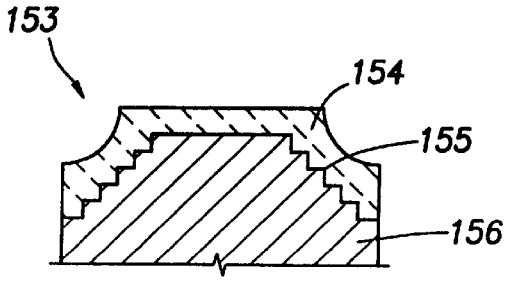

FIG. 31 illustrates a cutter 153 having a diamond cap 154 forming a wavy stairstep interface 155 with the underlying substrate 156.

Figure 32:
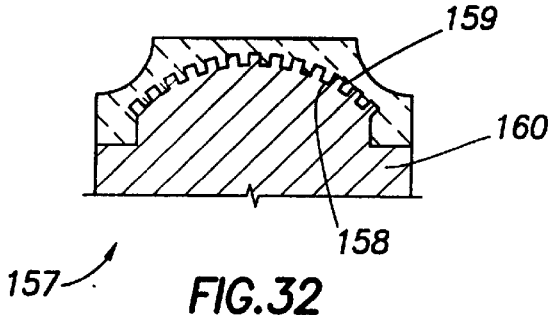

FIG. 32 illustrates a cutter 157 having a series of concentric substrate grooves 158 forming an interface 159 between the diamond cap and the underlying substrate 160.

Figure 33:
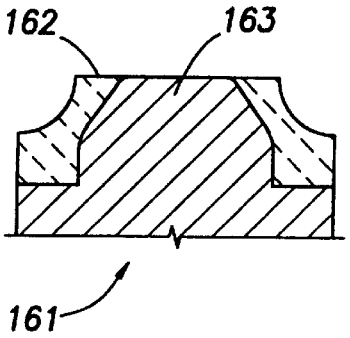

FIG. 33 illustrates a cutter 161 having an annular diamond ring 162 with the substrate 163 extending through the center of the ring to the planar top of the cutter.

Figure 34:
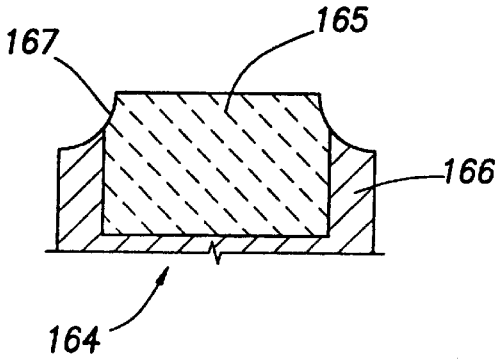

FIG. 34 illustrates a cutter 164 in which a cylindrical diamond segment 165 is set within a matching recess in the substrate 166. The diamond 165 includes the radiused surface 167 of the present invention, which extends into the carbide substrate 166.

FIG. 35 illustrates a blade 168 of the type commonly employed on fixed cutter bits. The blade may be welded onto a steel bit body or may be machined or cast into a steel or matrix body. The blade 168 is provided with the cutters 169, 170, 171, and 172 of the present invention. Radial sockets 173 are provided in the blade 168 to receive additional cutters. The cutters, which may be of the form illustrated in FIGS. 1–4, are inserted into the sockets and retained within the blade in a conventional manner to form a partial spiral array over the blade. It may be noted that the cutter faces of the cutters 169–172 are mounted facing the end of the blade 168 rather than the more conventional mounting facing from the side of the blade.

FIG. 36 illustrates a blade 174, like the blade of FIG. 35, having the cutters 175 of the present invention positioned on the blade in a conventional linear pattern along the outer blade edge.

FIG. 37 illustrates a similar blade 176 equipped with cutters 177 of the present invention, with the cutters being positioned to provide a continuous cutting edge on the blade comprised of the cutters' diamond caps extending from the mounting sockets. The tungsten carbide portion of the cutters is buried within the blade material such that only the diamond cutting faces of the cutters are exposed to the formation.

FIG. 38 illustrates the cutters of the present invention applied to a roller cone section 178 of a roller bit. Cutters 179 of the form illustrated in FIGS. 1–4 are disposed along the roller cone 180 and the supporting cone arm 181 to provide both cutting and side or gauge wearing action during the rotary motion of the bit. The depth of the cutter within the cone and arm may be varied to expose the desired amount of cutter to the formation. FIG. 38 illustrates that the cutters of the cone 178 are arranged to roll into engagement with the formation F along the leading edge of the intersection of the radiused surface and the cutter end face indicated at 183.

FIG. 39 illustrates a percussion drill bit, only partially displayed, indicated generally at 190, equipped with radiused cutters 191 of the present invention. The cutters 191, which may be any of the radiused forms described herein, are disposed on the bit such that a diamond interface 192 between a radiused side wall 193 and a planar end surface 194 is presented to the formation. The cutters 191 are mounted in sockets 195 formed in the body of the bit. The percussion bit 190 is repeatedly raised and lowered to sharply impact the formation F in a conventional manner to form a well bore.

It will be understood that the various cutters of the invention illustrated herein may be oriented or mounted on a bit body to engage the formation as indicated in FIG. 4 with the central axis of the cutter being inclined in the direction of the cutter movement, or the cutter may be mounted normal to the direction of such movement, or as indicated in FIGS. 27 and 28, the radiused forms of the cutters may be mounted with the central axis of the cutter inclined away from the direction of the cutter advancement.

The forms of the invention illustrated in FIG. 4A, in which a prior art cylindrical cutter with a diamond cap is employed for the cutting element is intended only to be mounted as illustrated in FIG. 4A. The novelty of the invention as applied to cutters such as that of FIG. 4A is in mounting the cutters such that the side of the cutter provides a cutting face that presents a curving leading edge producing a wear pattern that remains in diamond during a major portion of the cutter wear. This mounting also positions a major portion of the diamond behind the formation engagement point.

It will also be understood that while the cutter of the present invention has been described as a separate cylinder or stud to be mounted in a bit socket, the diamond cutting structure may be mounted on a projection integrally formed on the bit body. A cutter having the radiused surface of the present invention may also be fabricated of a single material rather than having the form of a capped substrate.

It will also be appreciated that the radiused surface of the cutting face of the present invention may be any curved surface that provides a concave surface along one dimension and a convex surface along another dimension wherein both dimensions share a common point on the surface. Such a radiused surface may not necessarily be a surface of revolution as described herein as the preferred surface, but may be, for example, an oval or other non-circular curving face.

Testing done on a cutter 41 of the present invention produced results indicating improved durability and cutting efficiency as compared with conventional cutters. The testing was done on a cutter such as the cutter 41 having the following dimensions indicated by the corresponding reference letters in FIG. 4:

J=0.325", the radius of a reduced cylindrical section of the tungsten carbide contained within the overlying diamond cap;

K=0.75", the longitudinal, or axial, length of the cylindrical cutter;

L=0.063", the longitudinal, cylindrical wall length of the diamond cap 44;

M=0.080", the diamond depth across the diamond cap from the base of the radiused outer diamond surface to an interface intersection between the diamond and the underlying substrate;

N=0.050", the lateral or radial width of the annular base of the diamond cap 44;

O=0.060", the longitudinal, or axial, thickness of the central diamond table overlying the axial end of the underlying tungsten carbide substrate;

P=0.087", the dimension of diamond taken at the indicated position between the interface between the outer radiused cutting surface and the planar diamond table and the transition from a conical side wall interface between the diamond and the tungsten carbide to the planar interface underlying the external planar diamond surface;

Q=0.187", the longitudinal development of the radiused cutting face between the base of the face at the cylindrical side wall of the cutter and the planar axial end surface;

R=0.187", the radius of curvature of the arc segment forming the segment for the surface of revolution about the central axis of the cutter 41; and S=0.375", the radial dimension of the cylindrical portion of the cutter.

In rock-cutting tests, the cutter was used to cut Sierra white granite mounted on a vertical turret lathe to present a flat rotating surface of rock to the cutter. The cutter was mounted with a negative back rake such that its central axis formed a 5° angle with a line normal to the planar surface of the stone. A 30° chamfer was employed on the diamond between the axial diamond end of the cap and the radiused side face surface. The turret lathe was adjusted to advance the cutter radially toward the center of the stone as the stone was rotated below the cutter to produce a spiral kerf in the granite table extending from the outer edge of the rock toward its center.

In the first test, with a depth of cut of 0.060 inches, a surface speed of the cutter over the rock of 20 inches per second, a feed rate of the turret lathe from the outer edge of the rock toward the center of 0.015 inches per revolution, and using a water coolant, 60.6 $in^3$ of rock was removed.

In a second test using the same cutter but in which the depth of cut was 0.100 inches, the surface speed was 30 inches per second, the feed rate was 0.125 inches per revolution, and the coolant was water, 101 $in^3$ of rock was removed.

After both tests, there was no visible wear on the cutting face. A wear flat will form on a conventionally mounted, standard polycrystalline diamond compact cylinder after the same tests are performed. The testing also verified that the diamond cap will not shear away from the tungsten carbide substrate during cutting when mounted in the described manner.

In a performance of granite log abrasion testing, using a cutter with the described dimensions and orientation but having no chamfer, under standard wet test conditions, the cutter of the present invention produced a "G ratio" (volume of rock cut divided by the volume of diamond worn away) of $21.9\times10^6$, while a conventional cutter exhibited a G ratio of $7.9\times10^5$ for the same test. It is theorized that the curving, nonplanar contact interface between the cutting face of the cutter of the present invention and the uncut formation is a more efficient cutting form than that presented by the planar engagement between the formation and a conventional cutting face.

Impact testing on a cutter having the dimensions and configuration of the cutter 41 illustrated in FIG. 5 were applied to the junction points between the planar end surface of the diamond cap and the curved side face and to the junction between the curved side face and the cylindrical wall section of the diamond as well as to the radiused wall section of the diamond. These impacts were as high as 100 joules. No damage was noted in any of the impact tests. A conventional cylindrical cutter with a cylindrical diamond cap will spaul under a 45 joule impact. It is theorized that the geometry of the cutter of the present invention may enhance impact resistance by producing a high compressive stress dispersion region in the diamond table.

In another set of tests, cutters were tested on a vertical turret lathe using Sierra white granite. The cutter of the present invention mounted with a negative back rake and a conventionally mounted cylindrical cutter were compared. Two different parameters were tested with each cutter. The first test used a depth of cut of 0.060" and a feed rate of 0.062" per revolution, while a second test used a depth of cut of 0.100" and a feed rate of 0.125" per revolution. Both tests used a surface speed of 20" per second. The cutter force and the normal force were measured, the cutter force being the force between the cutter face and the formation in a direction substantially parallel with the cutting movement and the normal force being the force against the cutter directed in a direction normal to the direction of motion. The cutter of the present invention exhibited an average increase in the normal force of only 3% over that of the conventional cylindrical cutter but showed an increase of 121% over the cutter force produced in the conventional cutter.

The foregoing description and examples illustrate selected embodiments of the present invention. In light thereof, variations and modifications will be suggested to one skilled in the art, all of which are in the spirit and purview of this invention.

What is claimed is:

1. A cutter for a drill bit comprising:

a mount section for securing said cutter to the bit;

a cutting section for cutting a formation as the bit is rotated;

a leading surface area included in said cutting section; and a concave cutting face on said leading surface area for engagement with uncut formation, said cutting face having the form of an external surface that forms a concave line of intersection with a first plane passing through said external surface along a first dimension and a convex line of intersection with a second plane passing through said external surface along a second dimension where said first and second planes also intersect on said external surface.

2. A cutter as defined in claim 1 wherein said cutting section is formed of a super-hard material.

3. A cutter as defined in claim 2 wherein said super-hard material is a polycrystalline diamond.

4. A cutter as defined in claim 3 wherein said cutter is symmetrically developed about a central axis.

5. A cutter as defined in claim 1 wherein said cutting section comprises a cap of super-hard material overlying a portion of said mount section.

6. A cutter as defined in claim 5 wherein said super-hard material is a polycrystalline diamond.

7. A cutter as defined in claim 5 wherein said cutter is symmetrically developed about a central axis.

8. A cutter as defined in claim 5 wherein said cap includes a planar external end surface.

9. A cutter as defined in claim 1 wherein said cutter is symmetrically developed about a central axis.

10. A cutter as defined in claim 7 wherein said cutting face is in the form of a surface of revolution of an arc segment.

11. A cutter as defined in claim 10 wherein said cutting section is formed of a super-hard material.

12. A cutter as defined in claim 10 where said cutting section comprises a cap of super-hard material overlying a portion of said mount section.

13. A cutter as defined in claim 12 wherein said cutting section is formed of a super-hard material.

14. A cutter as defined in claim 13 wherein said super-hard material is a polycrystalline diamond.

15. A cutter as defined in claim 14 wherein said mount comprises a tungsten carbide material.

16. A cutter as defined in claim 15 wherein said cap includes a planar external end surface and said cutting face is radiused in a lateral external wall of said cap.

17. A cutter as defined in claim 16 wherein said mount section includes a cylindrical body section with said cap disposed about one axial end of said mount section.

18. A bit having at least one cutter for cutting a formation, said cutter comprising:

a longitudinally and laterally extending cutting section of super-hard material having a curved side wall section and an end section, said cutter being oriented on said bit whereby said curved side wall section presents a leading surface area cutting face for engaging and cutting the formation and wherein said cutting face is in the form of a surface of revolution that is concave relative to the axis of revolution; and a laterally extending layer of super-hard material in said end section for protecting said cutter from the forces acting against said cutter as said formation is cut and for providing super-hard material in the wear area of said cutting section.

19. A bit as defined in claim 18 wherein said cutting section is constructed of polycrystalline diamond.

20. A bit as defined in claim 18 wherein said axis of revolution is a central axis of said cutting section.

21. A bit having at least one cutter for cutting a formation, said cutter comprising:

a longitudinally and laterally extending mount section;

a cutting section for cutting the formation as said bit is rotated;

a cap of super-hard material carried over one longitudinal end of said mount section;

a leading surface included on a side wall of said cap; and a curving cutting face in the form of a surface of revolution formed by a concave line formed on said leading surface for engagement with uncut formation, said cutter being oriented on said bit such that a major volume of said super-hard material in said cap is disposed rearwardly of said cutting face as said cutter is rotated into cutting engagement with the formation.

22. A bit as defined in claim 21 wherein said cutter is mounted on a roller cone of said bit.

23. A bit as defined in claim 21 wherein said cutter is mounted on said bit for percussion impact with said function.

24. A bit having at least one cutter mounted on a supporting bit body for cutting a formation, said cutter comprising:

a cutting section for cutting a formation as said bit is rotated;

a leading section on an axial end of said cutting section forming a substantially planar cutting face for engaging said formation; and a trailing side section on a lateral side of said cutting section extending between said axial end section and said bit body, said trailing side section including a surface in the form of a surface of revolution of a concave-shaped arc section relative to the axis of said revolution, said surface of revolution forming a convex line when said surface of revolution is intersected with a plane normal to said axis of revolution.

25. A bit as defined in claim 24 wherein said cutter is oriented on said bit body to engage uncut formation at longitudinally spaced locations along said trailing side section.

26. A bit as defined in claim 25 wherein one of said spaced locations is said substantially planar cutting face and another of said locations is adjacent said surface of revolution.

27. A bit as defined in claim 24 wherein said cutting section is comprised of a super-hard material.

28. A bit as defined in claim 27 wherein said super-hard material is a polycrystalline diamond.

29. A cutter for cutting a formation, comprising:

a longitudinally and laterally extending cutter body having an external wall extending between longitudinally spaced end areas of said body, said spaced end areas comprising a cutting end area and a mounting end area;

a planar end surface at said cutting end area of said body;

a curved surface formed in said external wall, said curved surface extending laterally and longitudinally between said cutting end area of said body and said external wall, said curved surface having a concave line of intersection with a plane extending longitudinally through said curved surface and a convex line of intersection with a plane extending laterally through said curved surface.

30. A cutter as defined in claim 29 wherein said curved surface is formed in a super-hard material comprising a part of said cutter.

31. A cutter as defined in claim 30 wherein said super-hard material is diamond.

32. A cutter as defined in claim 29 wherein said curved surface is a surface of revolution of an arc section.

33. A cutter as defined in claim 32 wherein the axis of said revolution is a central longitudinal axis of said cutter body.

34. A rotary, fixed cutter bit having at least one cutter mounted on said bit for continuous rotary engagement against a formation, said cutter comprising:

a mount section for securing said cutter to said bit;

a cutting section for cutting the formation as said bit is rotated;

a leading surface area included in said cutting section; and a concave cutting face on said leading surface area for engagement with uncut formation, said cutting face having the form of an external surface that forms a convex line of intersection with a first plane passing through said external surface along a first dimension and a concave line of intersection with a second plane passing through said external surface along a second dimension where said first and second planes also intersect on said external surface.

35. A bit as defined in claim 34 wherein said cutter is comprised of a super-hard material.

36. A bit as defined in claim 35 wherein said super-hard material is a diamond material.

* * * * *

UNITED STATES PATENT AND TRADEMARK OFFICE

CERTIFICATE OF CORRECTION

PATENT NO. : 6,003,623

DATED : December 21, 1999

INVENTOR(S) : David P. Miess

It is certified that error appears in the above-identified patent and that said Letters Patent is hereby corrected as shown below:

In column 13, line 4, delete "concave-shape" and insert therefor --concave-shaped--.

In column 13, line 21, delete "trailing the" and insert therefor --the trailing--.

In column 17, line 12, delete "7" and insert therefor --9--.

Signed and Sealed this

Ninth Day of January, 2001

*Attest:*

*Attesting Officer*

Q. TODD DICKINSON

*Commissioner of Patents and Trademarks*